US005349906A

United States Patent [19]

Devaux et al.

[11] Patent Number: 5,349,906

[45] Date of Patent: Sep. 27, 1994

[54] CARTRIDGE TUBE FOR RIFLE GRENADE CAPABLE OF RETAINING THE BULLET FRAGMENTS

[75] Inventors: Dominique Devaux; Caroline Hellio, both of Bourges; Jean-Gabriel Misse, Saint Florent sur Cher, all of France

[73] Assignee: Luchaire Defense SA, Versailles Cedex, France

[21] Appl. No.: 70,453

[22] PCT Filed: Dec. 3, 1992

[86] PCT No.: PCT/FR92/01145

§ 371 Date: Jun. 7, 1993

§ 102(e) Date: Jun. 7, 1993

[87] PCT Pub. No.: WO93/13382

PCT Pub. Date: Jul. 8, 1993

[30] Foreign Application Priority Data

Dec. 24, 1991 [FR] France ..... 91 16060

[51] Int. Cl.[5] ..... F42B 30/06

[52] U.S. Cl. ..... 102/485; 42/105

[58] Field of Search ..... 102/483, 484, 485; 42/105

[56] References Cited

U.S. PATENT DOCUMENTS

| | | | |
|---|---|---|---|
| 2,853,008 | 9/1958 | Bowles | 102/485 |
| 3,664,263 | 5/1972 | Driscoll . | |
| 3,726,036 | 4/1973 | Jennings et al. . | |
| 4,394,836 | 7/1983 | Chavee et al. | 102/485 |
| 4,567,831 | 2/1986 | Gordon et al. | 102/485 |
| 4,793,259 | 12/1988 | Ambrosi et al. | 102/485 |
| 5,153,374 | 10/1992 | Gabriels | 102/484 |

FOREIGN PATENT DOCUMENTS

| | | |
|---|---|---|
| 384487 | 11/1987 | Austria . |
| 1599746 | 8/1970 | France . |
| 2517820 | 6/1983 | France . |
| 2543284 | 9/1984 | France . |
| 2567639 | 1/1986 | France . |
| 2605399 | 4/1988 | France . |

*Primary Examiner*—Harold J. Tudor
*Attorney, Agent, or Firm*—Oliff & Berridge

[57] ABSTRACT

A cartridge tube for a grenade capable of being fired by a live round of a weapon has a bullet trap to stop the bullet and a plug made of a deformable material to prevent the fragments produced when the bullet impacts on the bullet trap from escaping from the cartridge tube. The plug bears against a wall positioned between the plug and the bullet trap. The wall is attached to the cartridge tube and is substantially perpendicular to the center-line of the tube. The wall is positioned at a distance from the bullet trap along the center-line of the cartridge tube, thus establishing an empty space between the wall and the bullet trap.

10 Claims, 5 Drawing Sheets

CARTRIDGE TUBE FOR RIFLE GRENADE CAPABLE OF RETAINING THE BULLET FRAGMENTS

BACKGROUND OF THE INVENTION

The present invention concerns a rifle grenade and, more precisely, the cartridge tube which is disposed at one end of the said grenade whereby it can be placed on the barrel of a rifle.

The cartridge tube of a rifle grenade contains a bullet trap according to prior art which, by stopping the bullet, allows the grenade to be fired by means of any kind of munition and in particular a live cartridge.

The deceleration of the bullet by the trap generates metal fragments (such as pieces of the bullet casing) and these fragments are ejected in the direction of the firer when the grenade leaves the barrel of the rifle.

These fragments are ejected even more violently when an additional propellant charge is placed in the cartridge tube. Attempts have already been made to limit or prevent such ejections by placing a plate made of elastic material at the entry to the bullet trap.

Reference may be made for example to French patent 1599746 which describes a bullet trap on which a plate made of an elastic plastics material is placed. The plate is penetrated by the bullet and closes again immediately thereafter, thus preventing fragments from being ejected towards the firer.

French patent 2517820 also describes a bullet trap for rifle grenades which incorporates a steel trap with a washer made of a damping material arranged inside a support tube. The trap is closed by a woven nylon cap the function of which is to protect the firer against the bullet fragments and which is tightly fitted or bonded to both the cartridge case and the trap.

Experience shows that these solutions are unsatisfactory and that bullet fragments are still projected out of the cartridge tube.

SUMMARY OF THE INVENTION

An object of the invention is to provide a cartridge tube which creates better protection for the firer by retaining the fragments of the bullet with greater efficiency than the known systems described above.

The subject of the invention is therefore a cartridge tube for a grenade capable of being fired from a weapon by a live munition, the tube containing first a bullet trap designed to stop the bullet and, secondly, a plug made of a deformable material, designed to prevent the fragments produced by the impact of the bullet on the bullet trap from escaping from the cartridge tube, this tube being characterised by the fact that the plug bears against a wall positioned between the plug and the bullet trap, the wall being attached to the cartridge tube and substantially perpendicular to the center line of the said tube, the wall being positioned at a distance from the bullet trap along the center line of the cartridge tube, thus establishing an empty space between the wall and the bullet trap.

This arrangement prevents any interference between the wall upon which the plug bears and the bullet trap at the time of impact of the bullet on the said trap. The wall also grips the plug which assists its reclosure after passage of the bullet.

The wall is attached to a support which is itself fastened to the cartridge tube and includes a bore which retains an outer surface of the plug.

This arrangement facilitates the fitting of the plug and improves its retention as well as its closure following its penetration by the bullet. Preferably, there is a concave depression in the surface of the plug facing the wall.

In a variant, the plug has notches distributed regularly over its outer surface. Also, there may be an opening in the wall of diameter greater than the diameter of the bullet.

The rear portion of the plug may have a smaller diameter than the bore in the support.

In a first embodiment of the invention, the support has a bearing surface against which the plug bears and the wall is attached to a cap which closes off the bore and presses the plug against the bearing surface.

In a variant, the support contains a certain number of orifices through which some of the propellant gases generated by the munition for igniting a rocket can pass and it also has a sealing ring fitted first to an outer surface of the bullet trap and secondly to a cylindrical extension of the cap.

According to another characteristic, the cylindrical extension of the cap constitutes a spacer which bears against the bullet trap and maintains the trap at a given distance from the wall.

In a second embodiment of the invention, the support has an end on which it bears and this end constitutes the wall. According to another characteristic, the bore in the support has an annular rim designed to retain the plug in an axial direction.

The distance between the deformable plug and that part of the bullet trap on which the bullet first makes contact will advantageously be greater than the total length of the bullet.

BRIEF DESCRIPTION OF THE DRAWINGS

The invention will be better understood from a reading of the following description of particular embodiments, with reference to the attached drawings in which.

DETAILED DESCRIPTION OF PREFERRED EMBODIMENTS

Figure 1:
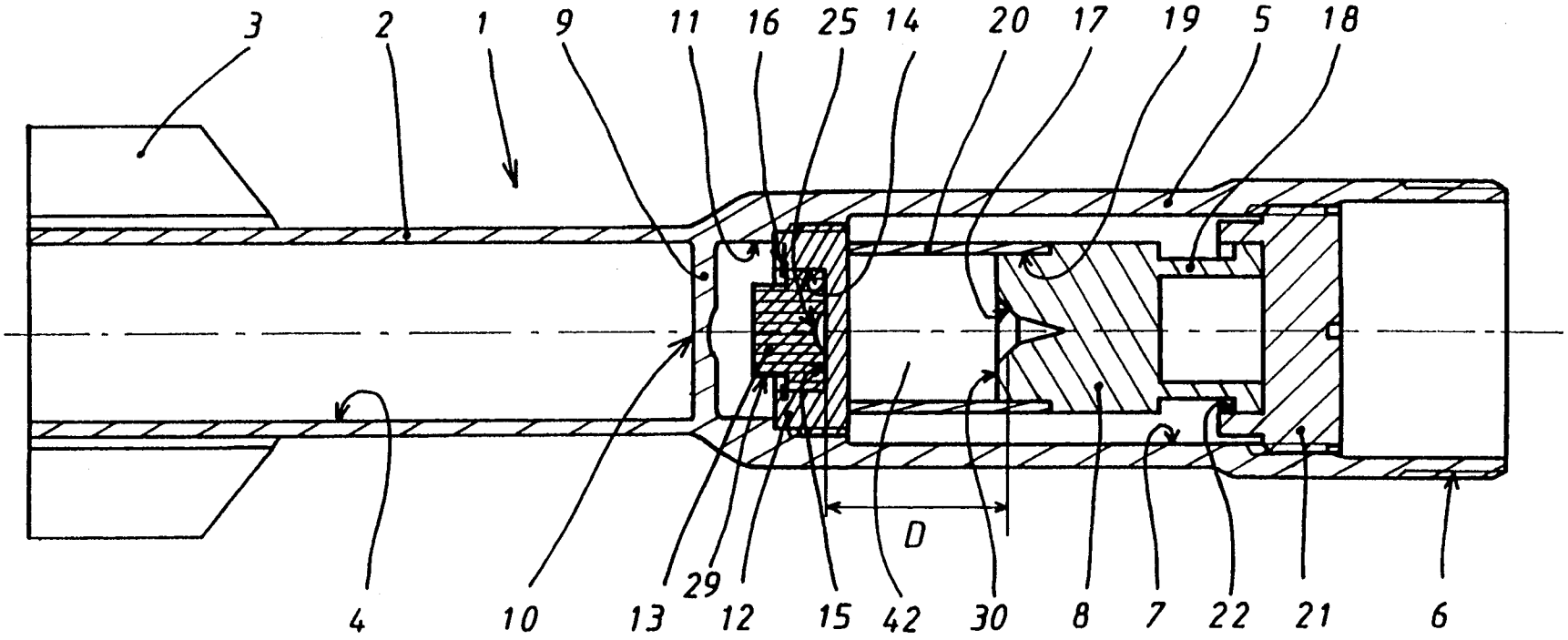
FIG. 1 is a longitudinal section of a cartridge tube according to a first embodiment of the invention.

With reference to FIG. 1, a cartridge tube 1 is designed to be attached to a rifle grenade (not shown). It has a rear part 2 which carries stabilization fins 3 in which a bore 4 is made allowing it to be placed on the end of a rifle barrel.

The cartridge tube also has a front part 5 which has a threaded zone 6 on its outer surface whereby it can be attached to a grenade of a known type (for example an anti-tank or anti-personnel grenade).

The front part 5 has a substantially cylindrical internal recess 7 inside which a bullet trap 8 of a known type (that described in patent FR 2543284) is positioned.

The internal recess 7 in the front part 5 is separated from the bore 4 in the rear part by a partition wall 9 the central part 10 of which has reduced thickness to facilitate penetration by the bullet (such a structure is described in patent FR 2605399).

The end of the internal recess 7 constitutes a cavity 11 which is bounded at the rear end by the partition wall 9 and at the end facing the bullet trap 8 by a support 12 in which a plug 13 is fitted.

The cavity 11 is filled by a propellant powder (not shown) ignited by the passage of the bullet and which serves to increase the range of the grenade in a known manner.

The support 12 has symmetry of revolution and it is threaded on the cartridge tube 1. Support 12 comprises a bore 14 and an end constituting a wall 15 which therefore lies between the plug 13 and the bullet trap 8. The bore 14 retains an outer surface of the plug 13.

The plug is held against the wall 15 by an elastic washer 16 fitted in an annular groove on the support 12.

The plug has a rear part 29 having a diameter which is slightly less (by about 1 to 2 mm) than that of the bore 14. The plug here is made from an elastomer of the polyurethane type whose hardness is 90 Shore A.

Another elastic material, which may or may not be a composite, with hardness for example between 80 Shore A and 60 Shore D could be used.

The plug has a concave depression 25 of spherical section made on the surface which bears against the wall 15.

This depression allows deformation of the plug which facilitates penetration of the plug by the bullet. The support is made of aluminium, but another material, such as a plastics material, could be used.

The bullet trap 8, made of steel, has a conical aperture 17 made on its rear surface which is designed to receive the bullet.

It is also provided with means of damping the impact of the bullet, here consisting of a collar 18.

The bullet trap 8 has a section of reduced diameter 19 on which a spacer 20 is fitted, made for example of aluminium. One end of the spacer 20 bears against the bullet trap and the other against the support 12 of the plug 13.

The bullet trap/spacer assembly is held in this position bearing on the support 12 by means of a nut 21 which is screwed into the cartridge tube 1 and has an internal bore 22 which centers the bullet trap 8 relative to the cartridge tube 1.

The spacer 20 maintains the bullet trap at a particular distance from the wall and therefore from the plug.

The distance between the bullet trap and the wall leaves an empty space 42 between these components.

The distance between the bullet trap and the plug will be chosen such that the bullet trap 8 does not come into contact with the wall 15 as the trap 8 deforms and also that there is an adequate volume of space between the wall 15 and the bullet trap to accommodate the bullet fragments.

In practice, a distance of 5 to 10 mm can be adopted between the plug and the rear of the bullet trap.

The operation of the device is as follows:

When the grenade carrying the cartridge tube of the invention is fired, the bullet first passes through the thinned central portion 10 of the partition wall 9, ignites the propellant composition in the cavity 11 and then passes through the plug 13 and its support 12.

The wall 15 against which the plug bears holds the plug in position relative to the cartridge tube during its penetration by the bullet.

The bullet thus compresses the material of the plug, which material is retained axially by the wall.

As a result, the shearing of the plug is limited to the zone through which the bullet passes. The closure of the plug is assisted and the plug can retain the fragments of the bullet.

Moreover, since the wall 15 is held at a distance from the bullet trap, the deformation of the trap during the impact of the bullet does not damage the plug.

The bore 14 firmly holds the outer-surface of the plug which also assists in the closure of the plug.

In the embodiment described here, the plug has a rear part of diameter less than the bore 14. This difference in diameter allows the material of the plug to expand radially during the impact of the bullet which facilitates the onset of penetration.

Figure 2:
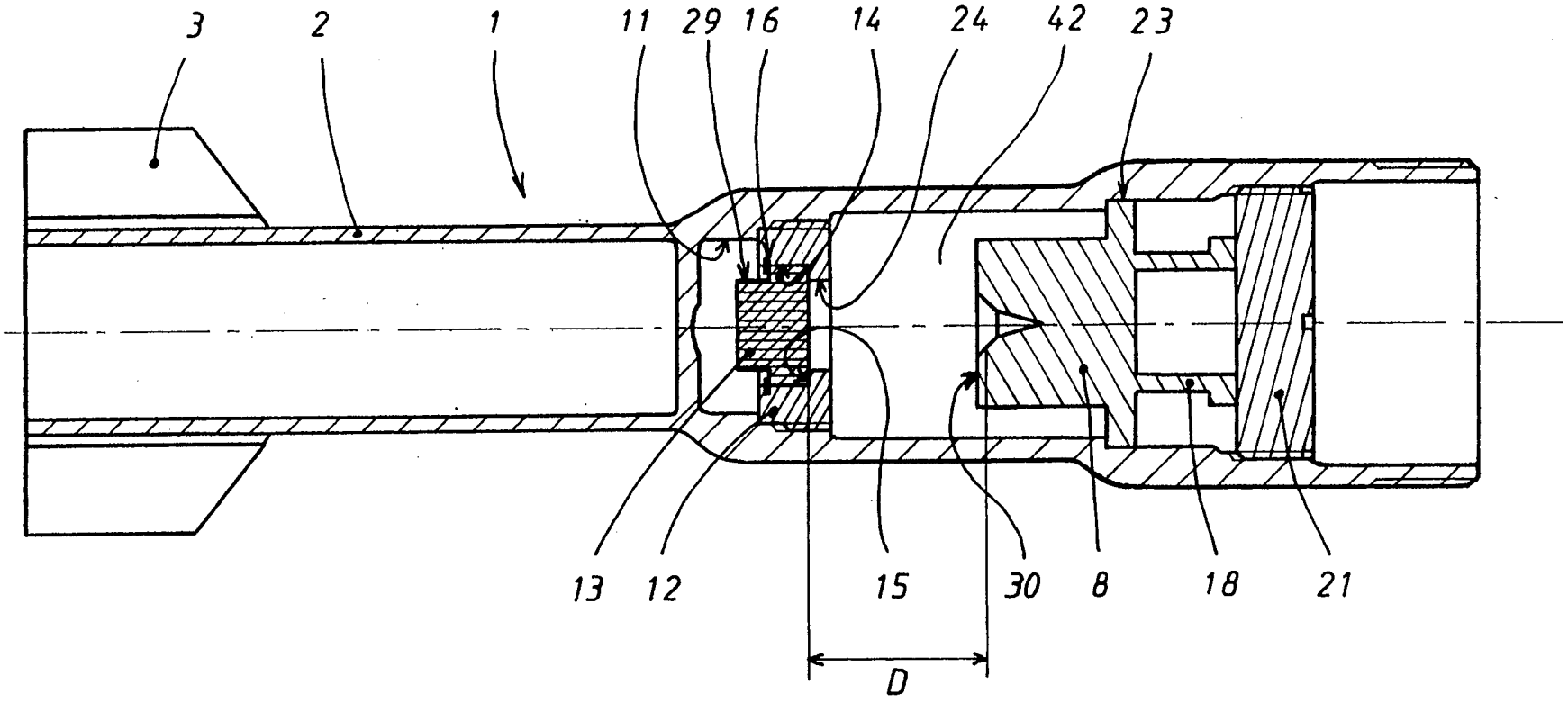
FIG. 2 is a longitudinal section of a cartridge tube according to a second embodiment of the invention.

The rear part of the plug could be given a conical section. FIG. 2 shows a second embodiment of the cartridge tube according to the invention in which the wall 15 of the support 12 of the plug 13 has an opening 24 having a diameter greater than that of the bullet.

The plug itself has no depression facing the wall 15. As the plug is penetrated, the material of the plug will deform through the opening 24. The support 12 holds the plug 13 both axially and radially through its bore 14 and its wall 15.

The bullet trap 8 has a cylindrical seat 23 which centers it relative to the cartridge tube 1 and also forms an axial stop held against an internal shoulder of the cartridge tube by the nut 21.

This stop ensures that the bullet trap is positioned at a distance from the wall.

Figure 3:
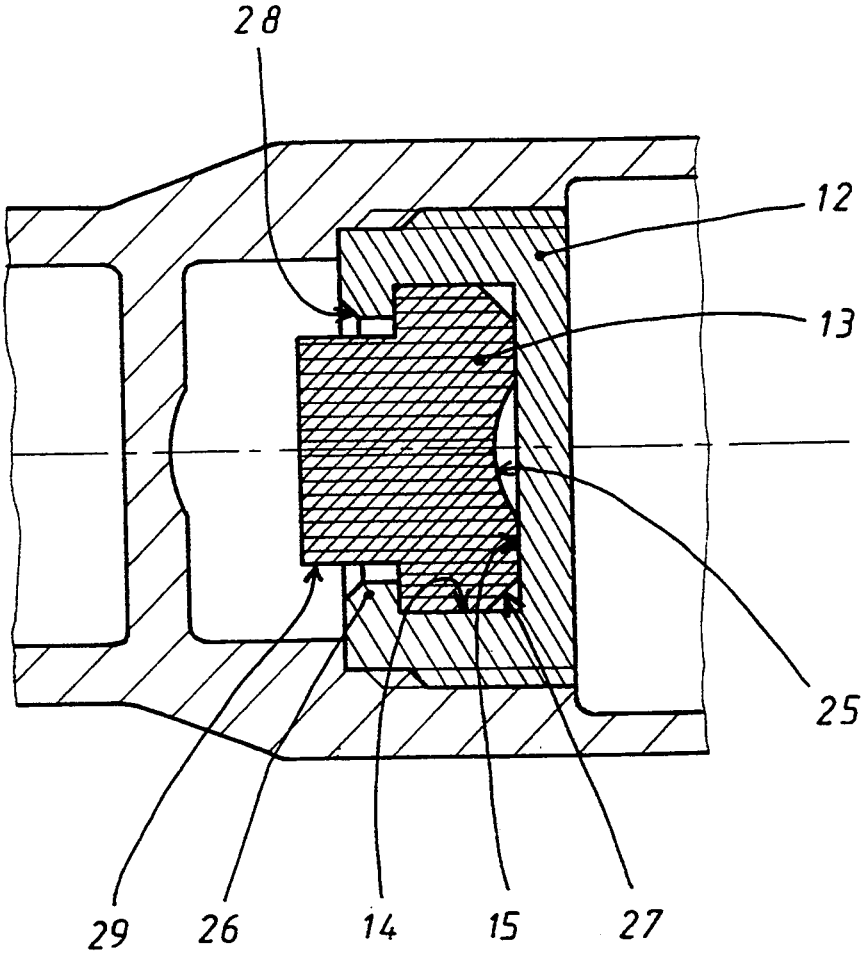
FIG. 3 shows a different variant of the plug support.

FIG. 3 shows a different version of the support 13 of the plug, which can be used in either of the cartridge tubes described above.

The internal bore 14 in the support 12 has an annular rim 26 which is designed to keep the plug bearing on the wall 15 and which thus replaces the elastic washer 16 described previously.

The plug 13 has a front chamfer 27 and the support 12 has a rear chamfer 28. The plug 13 is press fitted into the support 12.

This fitting is facilitated by the presence of the chamfers 27 and 28 and of the depression 25 which permits the elastic deformation of the plug.

In this way the plug is more rigidly gripped by the support and assembly is also made easier.

In a different embodiment of the invention, the distance between the bullet trap and the plug will be given a particular value.

Thus, with reference to FIGS. 1 and 2, the length of the spacer 20 would be chosen such that the distance D between the plug 13 and that part of the bullet trap on which the bullet impacts is greater than or equal to the length of the bullet.

With the bullet traps shown in FIGS. 1 and 2, the bullet comes into contact with the bullet trap at the conical opening 17 at about 2 mm from a rear surface 30 of the bullet trap.

Bullets of a given caliber may have different lengths according to their ballistic characteristics or their terminal effectiveness.

Thus, 5.56 mm caliber bullets available on the market have lengths substantially between 18 mm and 23 mm.

It is possible to choose a length D which is greater than the maximum possible length of the bullet at the caliber considered, say 23 mm for the 5.56.

It is also possible to choose a length D greater than the length of the bullet of the particular caliber which generates most fragments in the impact on the bullet trap.

With these variants the bullet which generates most fragments has completely passed through the plug 13 when it comes into contact with the bullet trap 8.

The plug will have closed again before this bullet impacts on the bullet trap, and therefore before the first fragments caused by this impact are projected towards the rear of the cartridge tube. In this way the effectiveness of the cartridge tube according to the invention is increased.

It is possible, without departing from the framework of the invention, to combine one or other of the variants described for the means of attaching the bullet trap with the different methods of making the plug support.

A propellant charge may or may not be placed inside the cavity 11.

The partition wall 9 may possibly be eliminated, whereupon the plug carried by the support will then constitute a seal at the front 5 of the cartridge tube.

In this latter case, it is possible to glue the plug 13 on a wall 15 obtained directly by machining the cartridge tube.

Figure 4:
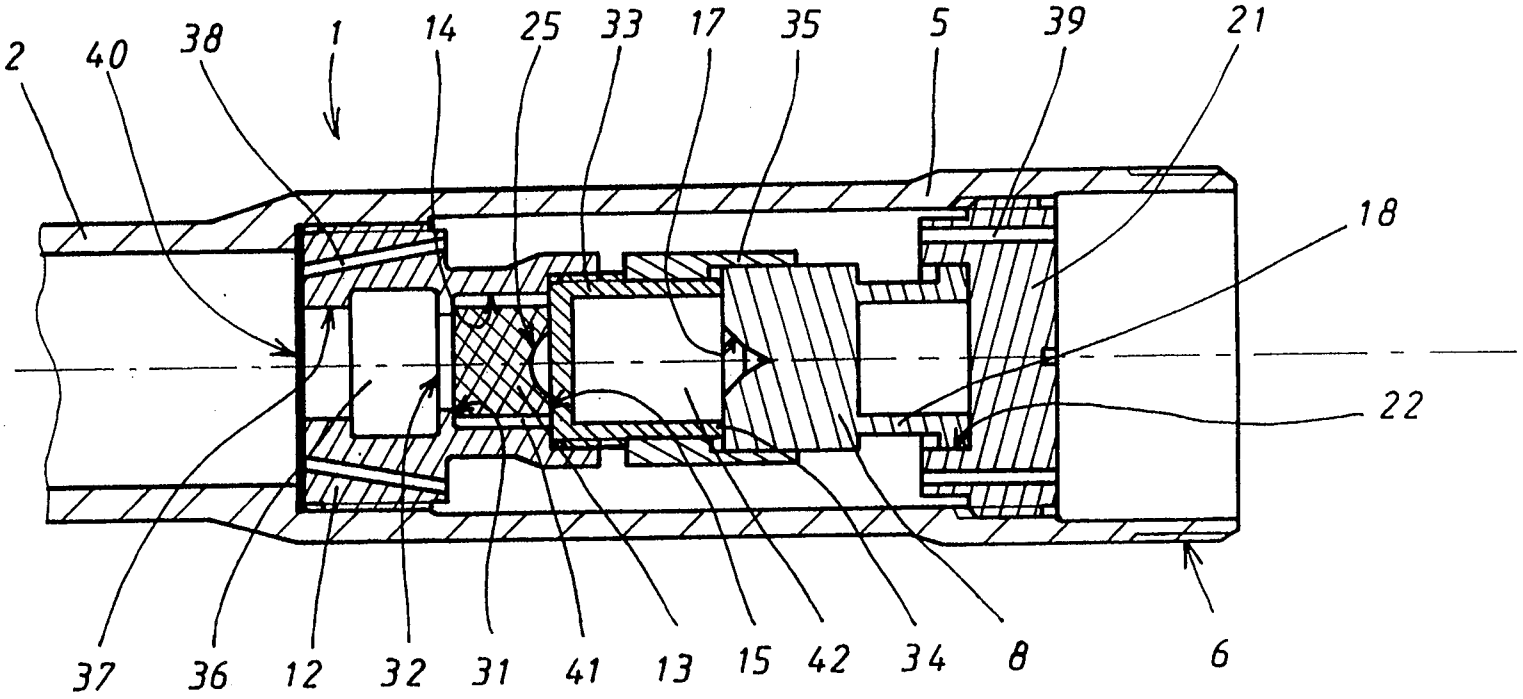
FIG. 4 is a longitudinal section of a cartridge tube according to a third embodiment of the invention.

FIG. 4 describes a third embodiment of a cartridge tube according to the invention. This particular method of construction allows the bullet fragments to be retained effectively while permitting the propellant gases generated by the munition to be used to ignite a rocket.

Igniting a rocket by utilizing gas is well known in the trade. Thus French patent 2567639 describes a grenade rocket mechanism which utilizes the propellant gases. This mechanism includes an annular bolt which retains a firing pin; the bolt is displaced by the pressure of the gases and releases the firing pin.

This mechanism does not form part of the present invention and will therefore not be described in more detail.

The cartridge tube according to this third embodiment therefore comprises a support 12 which is threaded on the cartridge tube 1. As in the preceding variants, this support has a bore 14 which holds an outer surface of the plug 13. The plug is pressed by a cap 33 against a bearing surface 31 attached to the support 12.

The bearing surface 31 is pierced by an opening 32 having a diameter greater than that of the bullet.

The cap 33 is threaded on the support 12. Thus, in this particular method of construction, the wall 15 is carried by the cap 33 which closes off the bore 14 and presses the plug 13 against the bearing surface 31.

The cap 33 has a cylindrical extension 34 constituting a spacer against which the bullet trap 8 bears. This spacer serves to maintain the bullet trap 8 at a distance from the wall 15 and thus establish an empty space 42 between these items.

The bullet trap is maintained in this position bearing on the cap 33 by means of a nut 21 which is screwed into the cartridge tube 1 and has an internal bore 22 which centers the bullet trap 8 relative to the cartridge tube 1.

As in the preceding methods of construction, the bullet trap 8 is made of steel and has a conical opening 17 made in its rear surface and which is designed to receive the bullet.

It is also fitted with means for damping the impact of the bullet, here consisting of a collar 18.

The distance between the bullet trap and the plug will be chosen such that the bullet trap 8 does not come into contact with the wall 15 as the trap 8 deforms and also that there is a sufficient volume of space between the wall 15 and the bullet trap to accommodate the bullet fragments.

A sealing ring 35 in plastics material is fitted both to the outer cylindrical surface of the bullet trap 8 and to an external surface of the cylindrical extension 34 of the cap 33.

The support 12 also has at its rear end a chamber 36 which is designed to accommodate a charge of propellant powder if appropriate. This chamber communicates with the rear part 2 of the cartridge tube through an aperture 37.

Figure 5A:
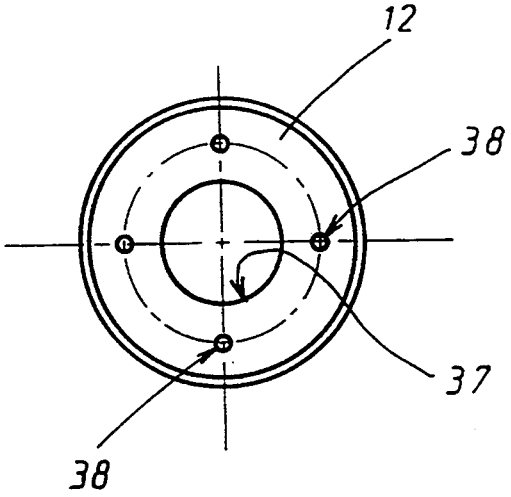
FIG. 5*a* is a rear view of the support used in the third embodiment.

The support 12 has four openings 38 distributed at regular angular intervals (see FIG. 5*a*), which are designed to allow some of the propellant gases generated by the munition to pass towards the front part of the cartridge tube.

These gases will be able to act upon the mechanisms of the rocket (not shown) by passing through channels 39 (distributed at regular angular intervals) made in the nut 21.

A closure pad 40 is positioned on the rear surface of the support 12 to shut off the openings 38 and the opening 37 to prevent moisture from penetrating into the cartridge tube during storage.

The plug 13 used in this particular method of construction incorporates a depression 25 designed to be positioned facing the wall 15.

Figure 5B:
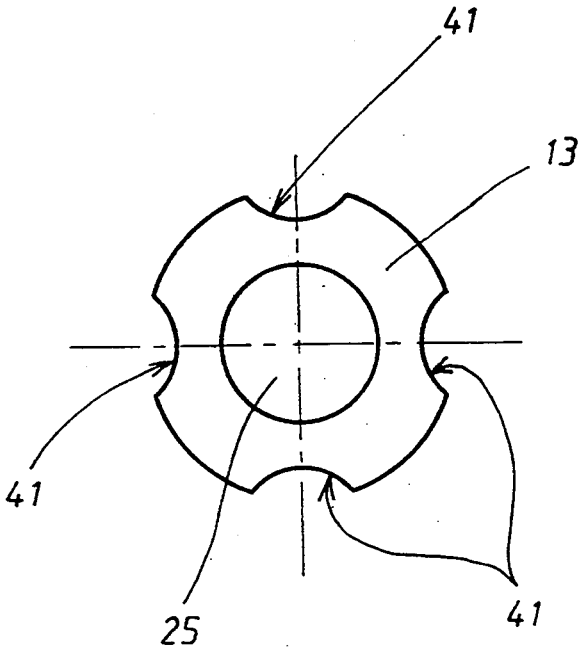
FIG. 5*b* is a front view of the plug used in this third embodiment.

It also comprises four notches 41 made in its outer cylindrical surface and arranged at regular angular intervals (see FIG. 5*b*).

These notches allow the plug 18 to expand radially when it is penetrated by the bullet thus assisting perforation of the plug and its closure after the bullet has passed, regardless the caliber of the bullet (5.56 mm or 7.62 mm).

The operation of the device is similar to that previously described. It will be noted however that the openings 38 and channels 39 serve to ignite the grenade rocket by means of the gases generated.

The ring 35 prevents the propellant gases from moving back towards the plug 13. Thus, the bullet fragments are retained by the plug and remain inside the empty space 42 bounded by the cylindrical extension 34 of the cap 33.

It is of course possible to combine the plug described in the framework of this particular method of construction, and which comprises notches made on its outer surface, with the variants of the cartridge tubes described previously with reference to FIGS. 1 to 3.

We claim:

1. A cartridge tube for a grenade fired from a rifle by a live round, the tube comprising:

a bullet trap for stopping a bullet;

a plug made of a deformable material for preventing fragments produced when the bullet impacts the bullet trap from escaping from the cartridge tube; and a support positioned between the plug and the bullet trap, said support comprising a bore delimited by a wall such that said support has a C-shaped cross-section, said bore retaining said plug, and said plug bearing against the wall, the wall being disposed between said bore and said bullet trap and attached to the cartridge tube and substantially perpendicular to a center line of the tube, the wall being positioned at a distance from the bullet trap along the center-line of the cartridge tube to create a space between the wall and the bullet trap.

2. The cartridge tube according to claim 1 wherein the plug has a depression facing the wall.

3. The cartridge tube according to claim 1, wherein the plug has a plurality of notches arranged at uniform intervals on an outer surface of the plug.

4. The cartridge tube according to claim 1, wherein the wall has a substantially central opening therethrough having a diameter greater than a diameter of the bullet.

5. The cartridge tube according to claim 1, wherein the plug has a rear portion with a diameter less than a diameter of the bore in the support.

6. The cartridge tube according to claim 1, wherein the support rests against a spacer disposed between said support and said bullet trap said wall resting against said spacer.

7. The cartridge tube according to claim 6, wherein the bore of the support has an annular rim to hold the plug in an axial direction.

8. The cartridge tube according to claim 1, wherein a distance between the deformable plug and a part of the bullet trap which the bullet first contacts is greater than the total length of the bullet.

9. A cartridge tube for a grenade fired from a rifle by a live round, the tube comprising:

a bullet trap for stopping a bullet;

a plug made of a deformable material for preventing fragments produced when the bullet impacts the bullet trap from escaping from the cartridge tube;

a wall positioned between the plug and the bullet trap, said plug bearing against the wall, the wall being attached to the cartridge tube and substantially perpendicular to a center line of the tube, the wall being positioned at a distance from the bullet trap along the center line of the cartridge tube to create a space between the wall and the bullet trap; and a support, wherein the wall is attached to said support and said support is attached to the cartridge tube, said support comprising a bore that holds an outer surface of the plug, wherein the support has a bearing surface on which the plug bears, said wall being attached to a cap that closes off the bore and presses the plug against the bearing surface, and wherein the support has a plurality of openings allowing a portion of propellant gasses generated by a munition to pass to ignite a rocket, said support further comprising a sealing ring fitted on an outer surface of the bullet trap and on a cylindrical extension of the cap.

10. The cartridge tube according to claim 9, wherein the cylindrical extension of the cap comprises a spacer that bears against the bullet trap and holds said trap at a distance from the wall.

* * * * *